United States Patent [19]

Maezawa et al.

[11] 4,379,641

[45] Apr. 12, 1983

[54] MULTI-ALARM ELECTRONIC WATCH

[75] Inventors: Shuji Maezawa; Masami Murata, both of Suwa, Japan

[73] Assignee: Kabushiki Kaisha Suwa Seikosha, Tokyo, Japan

[21] Appl. No.: 160,767

[22] Filed: Jun. 18, 1980

[30] Foreign Application Priority Data

Jun. 18, 1979 [JP] Japan ..... 54-77189

[51] Int. Cl.[3] ..... G04B 23/02

[52] U.S. Cl. ..... 368/74; 368/239; 368/261

[58] Field of Search ..... 368/41–44, 368/71–75, 239, 241, 250, 251, 242, 30, 82–84

[56] References Cited

U.S. PATENT DOCUMENTS

| | | | |
|---|---|---|---|
| 3,759,029 | 9/1973 | Komaki | 368/75 |
| 3,834,153 | 9/1974 | Yoda et al. | 368/251 |
| 4,087,679 | 5/1978 | Samreus | 368/250 X |
| 4,107,916 | 8/1978 | Kondo | 368/251 |
| 4,110,967 | 9/1978 | Fujita | 368/30 |
| 4,162,610 | 7/1979 | Levine | 368/41 |
| 4,233,681 | 11/1980 | Murata | 368/71 X |
| 4,255,804 | 3/1981 | Suganuma | 368/242 X |
| 4,272,836 | 6/1981 | Tamaru et al. | 368/74 |
| 4,303,995 | 12/1981 | Aizawa | 368/28 |

*Primary Examiner*—Vit W. Miska

*Attorney, Agent, or Firm*—Blum, Kaplan, Friedman, Silberman & Beran

[57] ABSTRACT

A multi-alarm watch includes a liquid crystal display means for providing both conventional time displays and an alarm time schedule display indicating simultaneously a plurality of times of day scheduled for an alarm signal. Separated or overlapped displays are used. The displays are driven by AC multiplexed voltage signals with each display having a different duty cycle. A random access memory stores data for the scheduled alarm circuitry and display. For greater visibility the scheduled display shows alarm times for twelve hours at one time and an address decoder converts timekeeping signals into a memory address code for the alarm schedule. A conventional alarm is also provided, and distinctive audible signals identify different functional outputs.

21 Claims, 13 Drawing Figures

FIG. 3
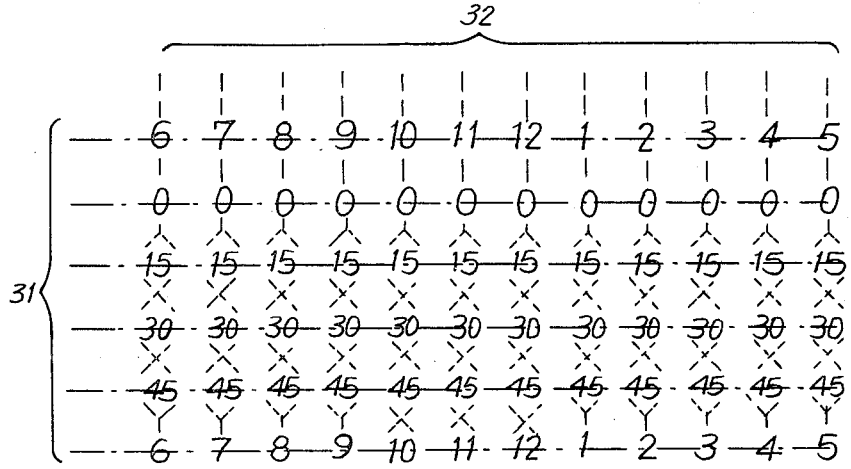
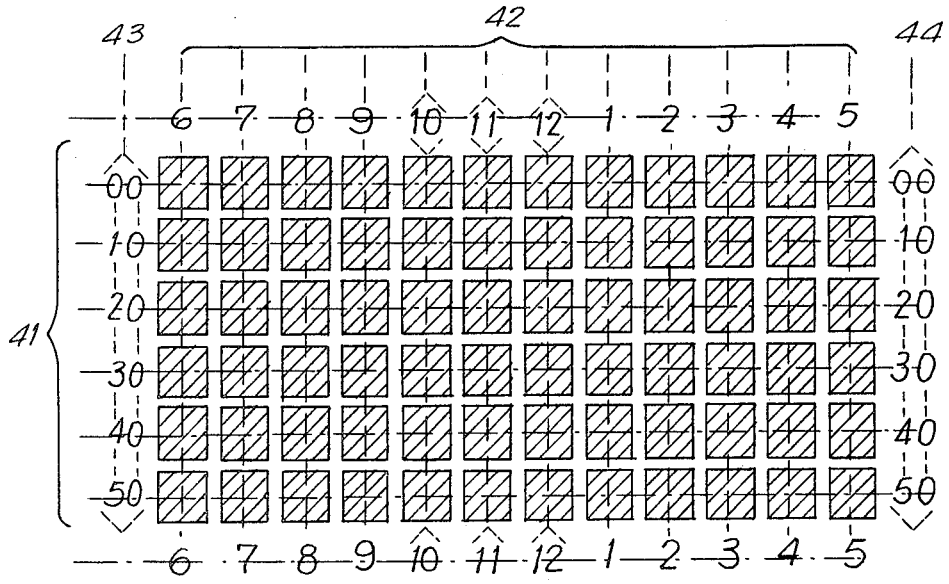
FIG. 4

MULTI-ALARM ELECTRONIC WATCH

BACKGROUND OF THE INVENTION

This invention relates generally to an electronic watch having a liquid crystal display and more particularly to a watch which displays a schedule of all alarm settings for a given day or a twelve hour period. In the prior art, many electronic watches are provided with a multi-alarm function, that is, the alarm sounds at several times during the day. In these conventional watches, the plurality of alarm times are accommodated in a plurality of memory circuits and the alarm times are set using the digit display in a conventional manner. However, the time setting for a plurality of alarms in such a watch is a rather complex operation and the alarm set times can only be called to display and confirmed one at a time. The entire schedule of alarms cannot be shown at one time. As a result, it can be expected that the use of the watch becomes more difficult as the number of alarm times which can be set for a given day is increased.

What is needed is a multi-alarm watch which is easily set for a plurality of alarm times and the entire schedule of alarm times is easily viewed by the display of an entire day's schedule or a schedule divided into twelve hour portions.

SUMMARY OF THE INVENTION

Generally speaking, in accordance with the invention, a multi-alarm watch having a capability to display a plurality of alarm time settings simultaneously is provided. The multi-alarm watch includes a liquid crystal display means for providing both conventional time displays and an alarm time schedule display indicating simultaneously a plurality of times of days scheduled for an alarm signal. Separated or overlapped displays are used. The displays are driven by AC multiplex voltage signals with each display having a selected duty cycle. A random access memory stores data for the schedule alarm circuitry and display. For greater visibility, the schedule display shows alarm times for twelve hours at one time and an address decoder converts timekeeping signals into a memory address code for the alarm schedule. A conventional alarm is also provided, and distinctive audible signals identify different functional outputs. Supplemental functions, such as a chronograph, are also provided.

Accordingly, it is an object of this invention to provide an improved multi-alarm electronic watch capable of displaying a substantial portion of the alarm schedule at one time.

Another object of this invention is to provide an improved multi-alarm electronic watch which has a separate display for time functions and for alarm schedules.

A further object of this invention is to provide an improved multi-alarm electronic watch having separate displays and using AC multiplex voltage driving signals.

Still another object of this invention is to provide an improved multi-alarm electronic watch having distinctive alarm sounds to represent different functions and different times of day.

Yet another object of this invention is to provide an improved multi-alarm electronic watch using a random access memory to store a plurality of alarm set times.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 3 and 4 illustrate electrode constructions of a schedule display portion for the timepieces of FIGS. 1 and 2;

DESCRIPTION OF THE PREFERRED EMBODIMENTS

Figure 1:
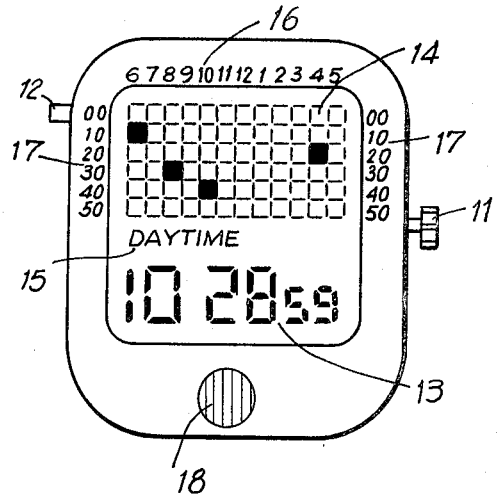
FIG. 1 is a front view of a multi-alarm electronic watch in accordance with this invention.

In accordance with the present invention, a multi-alarm electronic watch is provided which comprises a liquid crystal display means for effecting a normal time display and for effecting a time schedule display. The watch also comprises an electronic circuit capable of setting a plurality of alarm times by the operation of external switches and used in conjunction with the schedule display. The watch also provides means for generating audible alarm sounds at the alarm set times. FIGS. 1 and 2 show front views of two embodiments in accordance with the present invention.

FIG. 1 shows a first embodiment of the present invention in which the liquid crystal display means is distinctly divided into a first portion for a conventional time display and second portion for a time schedule display. More specifically, the liquid crystal display means is provided at its upper half with a time schedule display 14 and at its lower half with a conventional time display 13. An indicator 15 is displayed at the center for showing whether the content of the schedule is for the daytime or the nighttime. FIG. 1 shows that the alarm times are set at 6:10, 8:30, 10:40 and 4:20 in the daytime, that is, including both AM and PM hours. In order to make the alarm set times readable, the liquid crystal display means is formed with a scale 16 of hours from 6 to 5 o'clock arranged in columns, and with a scale 17 of 00, 10, 20, 30, 40 and 50 minutes arranged in horizontal rows. The watch is equipped with a rotary switch 11 and a push-type switch 12 for correcting the time and for setting the alarms in the schedule. A buzzer 18 serves for generating the alarm sounds. The watch body is provided internally with a battery, a crystal oscillator, integrated circuits, parts related to the switch contacts, and other components.

Figure 2A:
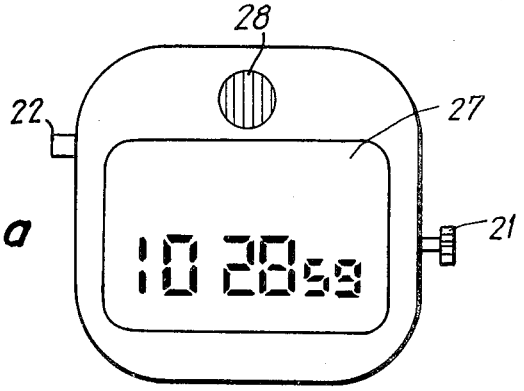
FIGS. 2*a* and 2*b* are front views of another multi-alarm electronic watch in accordance with this invention.
Figure 2B:
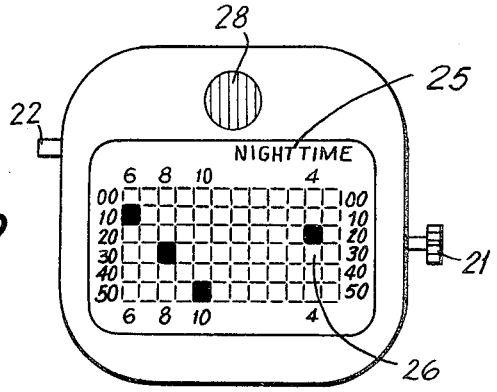
Figure 11:
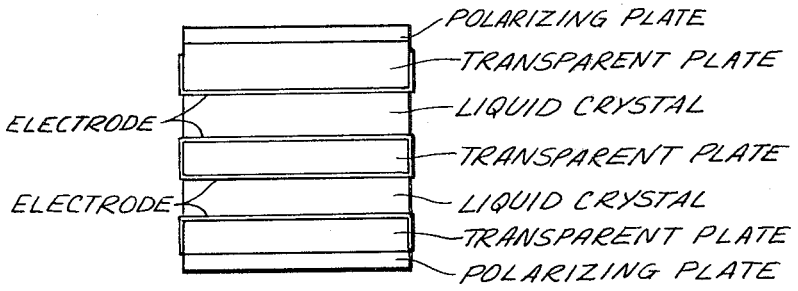
FIG. 11 is a simplified cross-sectional view of a multilayer liquid crystal display device.

FIGS. 2*a,b* show a second embodiment of the present invention. The liquid crystal display means has an electrode construction having two overlapped liquid crystal layers in which the time display and the schedule display are effected separately, one in each layer in an interchangeable manner. A liquid crystal display means having the two liquid crystal layers is used in a watch which is well known under the trade name of Seiko Digital Watch No. M354 by the Seiko Company of Japan, and is formed in a sandwich construction of three glass plates with electrodes. The intermediate glass plate is constructed with electrodes on both sides, and on the electrodes crystal layers are mounted. External polarizing plates are provided such that the crystal layers each have electrodes on both surfaces. FIG. 11 is a simplified representation of such a multi-layered display. The U.S. patent application Ser. No. 853,925, filed Nov. 22, 1977, for a Multi-Layer Display Device for a Timepiece, and its continuation-in-part application, disclose such a display construction. These applications, which are assigned to the same assignee, are incorporated herein by reference.

FIG. 2(*a*) shows the conventional time display 27. FIG. 2(*b*) shows the schedule display 26 and the daytime and nighttime indicator 25. The display data is similar to that shown in FIG. 1 except that the indication 25 shows nighttime in FIG. 2(*b*) whereas the indicator 15 shows daytime in FIG. 1. The watch is equipped with a rotary switch 21, a push-type switch 22 and a buzzer 28 similar to the design of FIG. 1.

The electrode pattern of the time display portion is not especially different from that of the prior art watches, but where the alarm schedule is interchanged every half day for daytime and nighttime displays, an addtional electrode for the indicator 15, 25 is provided. The electrode patterns of the schedule display portion are fundamentally similar for the first and second embodiments so that they are described together. The schedule display portion is provided with a group of electrodes which are divided into columns for each hour, and a group of electrodes which are divided transversely into rows for each ten or fifteen minute interval. Thereby, the scheduled time content is displayed in a grid.

FIGS. 3 and 4 show embodiments of electrode constructions in accordance with the present invention. A third embodiment is shown in FIG. 3 wherein a group of electrodes for the schedule display are so shaped that the corresponding minute time-set for alarm is digitally displayed. In this embodiment, the columns are divided longitudinally for each hour and transversely for each fifteen minute increment so that the alarm times are set by fifteen minute intervals. The portions where the electrodes of the common system 31 and the segment system 32 overlap, that is, the display elements, are made to have the shapes of the numbers 0, 15, 30 and 45. This design is advantageous in that the display elements of the hour and minute of the set alarm times, when turned on, can be clearly and quickly recognized. It is unnecessary to provide electrodes for the minutes scale 17 (FIG. 1). In FIG. 3, solid lines indicate overlapped display elements, vertical broken lines indicate the electrode lines 32 of the segment system, and horizontal broken lines indicate the electrode lines 31 of the common system.

A fourth embodiment, shown in FIG. 4, provides electrodes 43, 44 for displaying the minute time of each row in addition to the electrode groups 41, 42 for the grid of the schedule display. In accordance with this embodiment, the columns are longitudinally segregated for each hour, and the transverse rows are segregated for each ten minute period so that the alarm times can be set for every ten minutes. Because the overlapped display elements are rectangular and not shaped as numbers, electrodes 43, 44 are provided on both sides of the display which allow the minute set time to be read out.

Even when the liquid crystal drive margin is reduced so as to produce a half tone phenomenon when the number of common electrodes is increased in a multiplex drive, it is possible to obtain an advantage in that the pattern puts less strain on the observer's eyes as the display pattern becomes simpler. In FIG. 4, solid lines indicate the crossed display elements; broken lines 42 indicate the electrode lines of the segment system, and broken lines 41 indicate the electrode lines of the common system.

Moreover, it is also suitable that the minute time scales 43, 44 are placed on the peripheral portions of the displays means by a printing process as may also be done in the embodiment of FIG. 1. It should be noted that in the first, second, third and fourth embodiment (FIGS. 1–4), the electrode and circuit constructions are such that the schedule display is effected in an interchanging manner showing a half day or twelve hours in each mode. An advantage is obtained in that the display element are much less clear when the alarm settings for an entire day are displayed simultaneously. The alarm set schedule can generally be used for both AM and PM when it is divided for display of twelve hours at a time. However, when the display means are constructed in a large size, for example, as applied to a table clock rather than a wristwatch, a construction producing the scheduled display for an entire twenty-four hours is naturally acceptable. Because there are many instances where an alarm is not needed during the night, it is also possible to produce a schedule display only showing the hours from 7 o'clock AM to 7 o'clock PM.

A method and apparatus for driving the display means is described hereinafter. When the time display portion (FIG. 2(*a*)) and the schedule display portion (FIG. 2(*b*)) are entirely separate so that different panels are used for each display, it is enough that suitable liquid crystal materials are used between the electrode plates of the display. However, the construction using a single display panel or a 2-layered panel is more advantageous in cost of production and in appearance. Because in these displays the number of display elements is large, it is necessary to adopt a generalized AC amplitude selective multiplexing system for driving the liquid crystal display means so that the number of electrode terminals may be reduced. It is a design requirement that the time display have sufficient contrast and the same liquid crystal material is used for the schedule display although it has a relatively larger number of common electrodes.

In a fifth embodiment of a display, the conventional time display portion is driven by a V-2 V driving method using a ½ duty cycle signal. The schedule display portion is driven by a V-3 V driving system using a $\frac{1}{4}$ or 1/6 duty cycle signal. The $\frac{1}{4}$ duty cycle signals are used when the time schedule is broken down in fifteen minute intervals. The 1/6 duty cycle signals are used when the time schedule is set to show ten minute intervals. A reference voltage is defined at $V_0$, for example, 1.5 volts from a battery, and voltages of 2 $V_0$ and 3 $V_0$ are provided by a voltage boosting process in the conventional manner. The three levels of 0, $V_0$ and 2 $V_0$ are used in the time display portion, whereas four levels, namely, 0, $V_0$, 2 $V_0$, and 3 $V_0$, are used for the schedule display portion. The effective value of the signal applied to picture elements in the time display portion to produce an ON condition is $\sqrt{5/2}\ V_0=1.58\ V_0$. The effective value of signal applied to the picture elements which are to be OFF is $\sqrt{\frac{1}{2}}V_0=0.71\ V_0$. The effective value of the signal applied to portions in the schedule display which are to be OFF is $V_0$, and the effective value of the signal applied to portions of the schedule display which are to be ON is $\sqrt{3}\ V_0=1.73\ V_0$ for a $\frac{1}{4}$ duty cycle signal and $\sqrt{7/3}\ V_0=1.53\ V_0$ for a 1/6 duty cycle signal.

Because the contrast of the liquid crystal display is dependent upon the effective voltage of the drive signals, as is well known in the art, the time display becomes clear, that is, has good contrast, when a liquid crystal material is selected which is lit with a sufficient contrast for a voltage level of 1.58 $V_0$. Also, the selected liquid crystal material must be slightly lit for the voltage level of 0.71 $V_0$. The liquid crystal display means for the schedule display has a sufficient contrast when it is turned ON, although it still has a half-tone when it is turned OFF.

The fifth embodiment, as described thus far, is provided with two electrodes of a common system in the time display portion. However, in order to reduce the number of electrode terminals, it is necessary to provide three electrodes of a common system thereby to effect a time display with a $\frac{1}{3}$ duty cycle.

In a sixth embodiment, therefor, the conventional time display portion is driven by a V-3 V driving system using a $\frac{1}{3}$ duty cycle, and the schedule display portion is driven by a V-3 V driving system using a $\frac{1}{4}$ duty cycle signal. In this instance, the effective values (root-mean-square) for turning the time display portion ON is $\sqrt{11/3}\ V_0=1.91\ V_0$. The effective value for turning the display OFF is $V_0$, so that the schedule display portion may have insufficient contrast when it is turned ON if it uses the same liquid crystal material as the time display portion uses.

Figure 5:
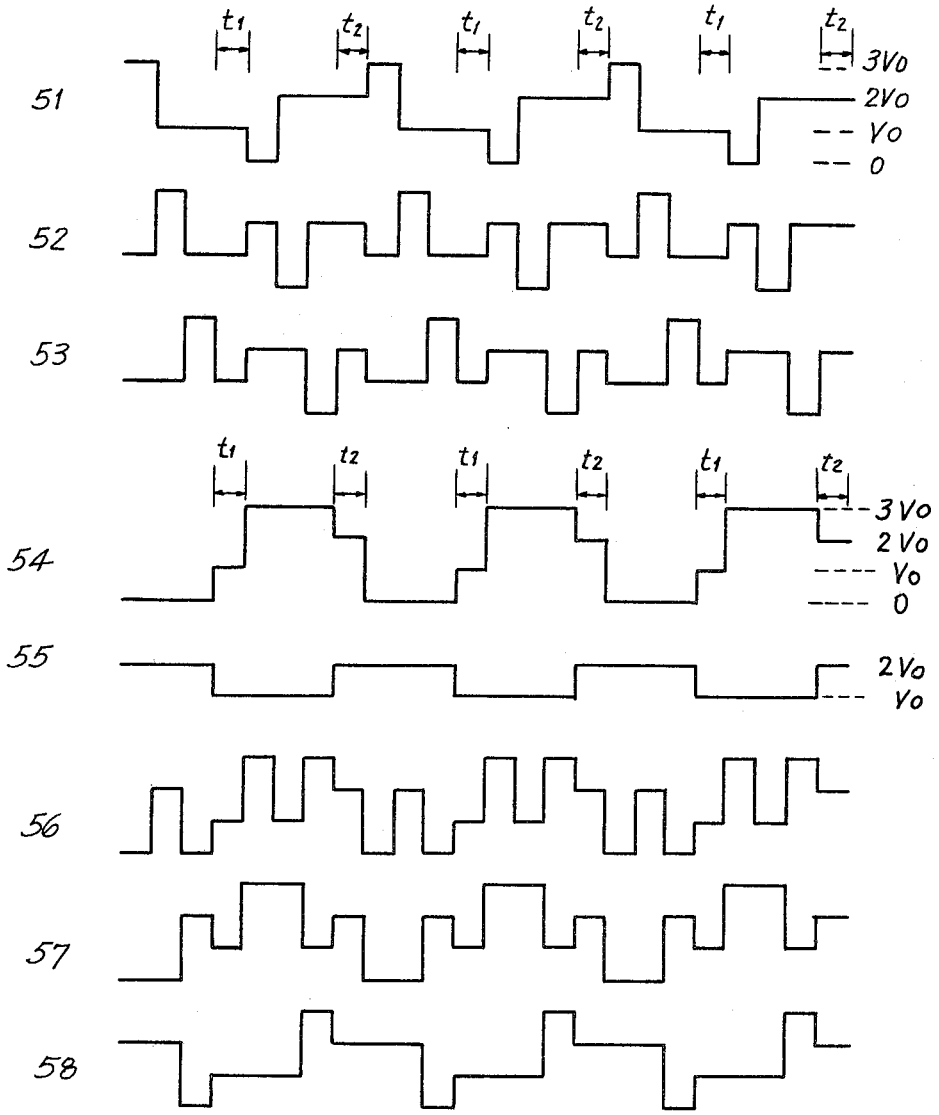
FIG. 5 shows signal wave forms for the time portion of the display of watches of FIGS. 1 and 2.
Figure 6:
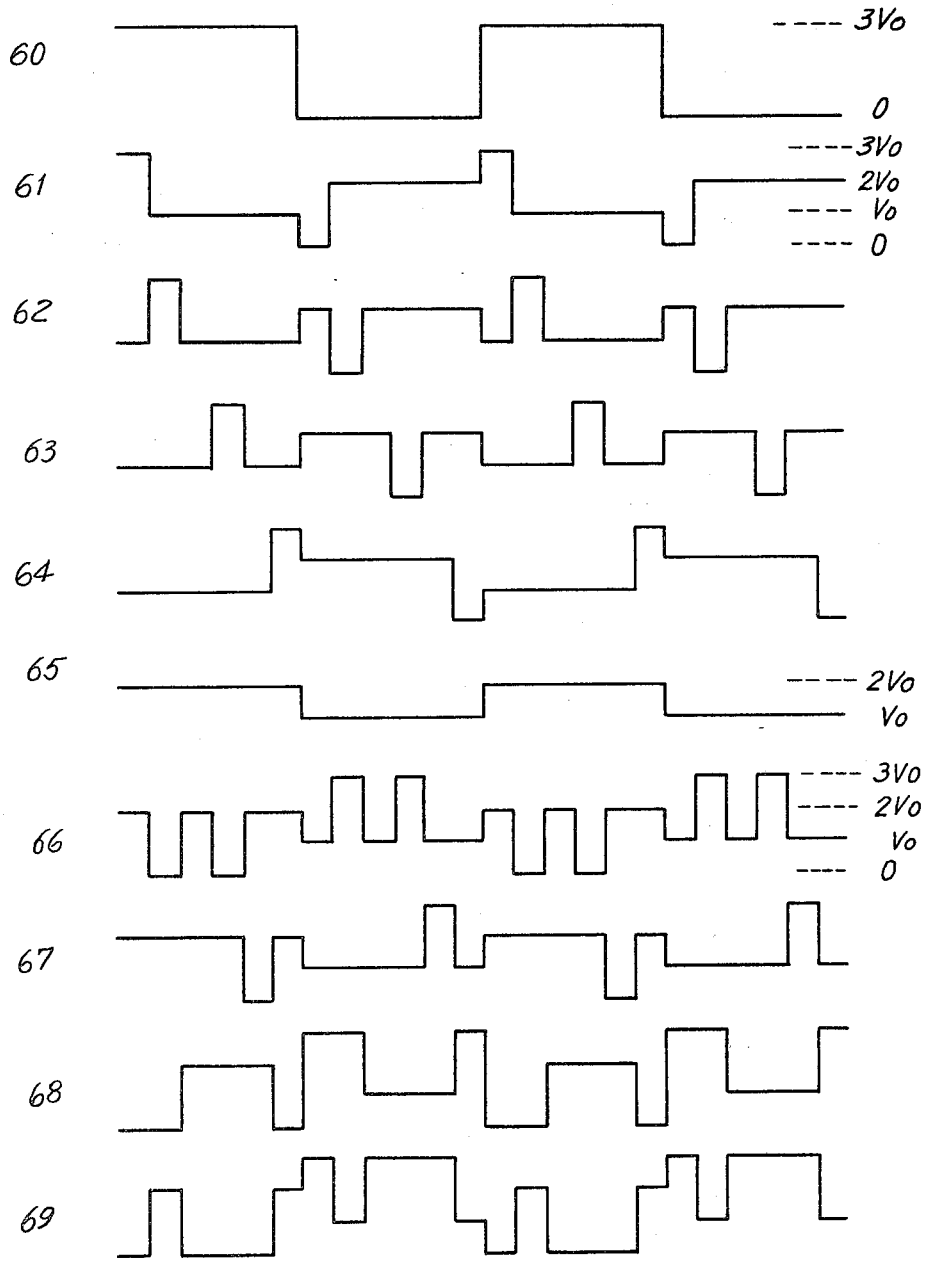
FIG. 6 shows the signal wave forms for the schedule portion of the display of the electronic watches of FIGS. 1 and 2.

In a seventh embodiment, which is an improvement over the sixth embodiment, the drive of the conventional time display portion is performed by a V-3 V driving method using a $\frac{1}{3}$ duty cycle signal. The signals of both the common system and the segment system are equally maintained at the same electric potential for a time period of $\frac{1}{4}$ of one period in the AC multiplex signal, thereby lowering the effective voltage. Signal wave forms in the time display portions and signal wave forms in the schedule display portion of this embodiment are shown in FIGS. 5 and 6 respectively. Signals 51, 52, 53 are for the common lines of the time display whereas the signal 54 is used for the segment lines. Where the common electrodes to which the signals 51, 52, 53 are applied cross the segment electrodes to which the signal 54 is applied, the display elements are turned ON, ON and ON. When the signals 56,57, 58 are applied to the segment lines and a signal 55 is applied as a segment signal, display elements where the common electrodes and the segment electrodes are overlapped are respectively turned OFF, OFF and OFF. In a similar manner, display elements are turned ON, OFF and ON by a signal 56, ON, ON and OFF by a signal 57, and OFF, OFF and ON by a signal 58. Three other kinds of segment signals are effective but are omitted from description here.

As will be apparent from FIG. 5, the respective signals are set at the potential $V_0$ at time $t_1$ and at the potential $2V_0$ at the time $t_2$. The drive voltages are at 0 as time passes. More specifically, no voltage is applied for a $\frac{1}{4}$ period of the AC cycle even when the display is turned ON or OFF. The effective value of the ON operation assumes a value of $\sqrt{11/4}\ V_0=1.66\ V_0$, and the value for the OFF operation assumes a value of $\sqrt{\frac{3}{4}}\ V_0=0.87\ V_0$. Therefore, when the schedule display portion uses the same liquid crystal material as the time display portion, the schedule display portion is also satisfactorily driven with a proper contrast.

FIG. 6 shows signals for use with a 1/6 duty cycle. Signal 61, 62, 63, 64 are the type used for the common system. There are two additional common system signals which are not shown. Signal 65, 66, 67, 68 and 69 are typical signals for the segment electrodes. Sixty-four different segment signals are used. A special common signal 60 is applied to the electrodes associated with the time scale indications, for example, scale 16 of FIG. 1. When a signal 60 is applied, the display elements which are crossed with any segment system driving signal, accepting the signal 65, are turned ON.

The segment signals described heretofore can be easily produced by operating an analog switch circuit in response to control signals. The control signals are generated by combining the output signals of counters and decoders with timing signals, and the output signals of the counters and decoders determine whether the respective display elements are turned ON or OFF.

An eighth embodiment in accordance with this in invention is provided with a separate alarm time setting circuit in addition to the setting circuit used with the schedule. This alarm time setting circuit uses the conventional time display to effect an alarm set so that the setting can be done with an accuracy of one minute. Such accuracy cannot be accomplished by using the schedule setting operations which operate with increments of ten or fifteen minutes. The alarm setting circuit which uses the conventional time display included a coincidence circuit for sensing the output bits of the timekeeping counters of conventional time and the alarm set bit signals.

In a generalized construction (FIG. 12), an oscillator 100 outputs a standard frequency signal which is divided down in divider circuits 102 to produce lower frequency signals. The lower frequency signals are accumlated in selected categories, for example, minutes, ten-minutes, hours, etc., in timekeeping circuits 104. The outputs of the timekeeping circuits 104 pass to a driver circuit 106 and display 108 by way of a control circuit 110. By operation of external members 112, 114, a selected alarm time is rapidly brought to display and the set time data is stored in an alarm memory 116. A comparator 118 compares the instantaneous data of the timekeeping circuits 104 with the alarm set time data stored in the alarm memory 116, and upon coincidence in the data, causes the alarm sound generator 120 to emit an audible alarm.

A ninth embodiment in accordance with the present invention is provided with a circuit for a chronograph function and with a circuit which is operative to generate alarm sounds at a selected time in synchronism with the time measurements of the chronograph. In addition, the circuit generates alarm sounds in cooperation with the schedule setting circuits.

A circuit having a chronograph function is comprised of a series of counters which are different from the normal timekeeping counters. The chronograph circuit also comprises a control signal circuit and a display changeover circuit. The alarm time is set by use of a setting counter or a latch circuit and the normal time display is used in setting the alarm time. The alarm generating signals are initiated by a coincidence circuit sensing the data bits of the chronograph counter and the preselected bits.

Figure 12:
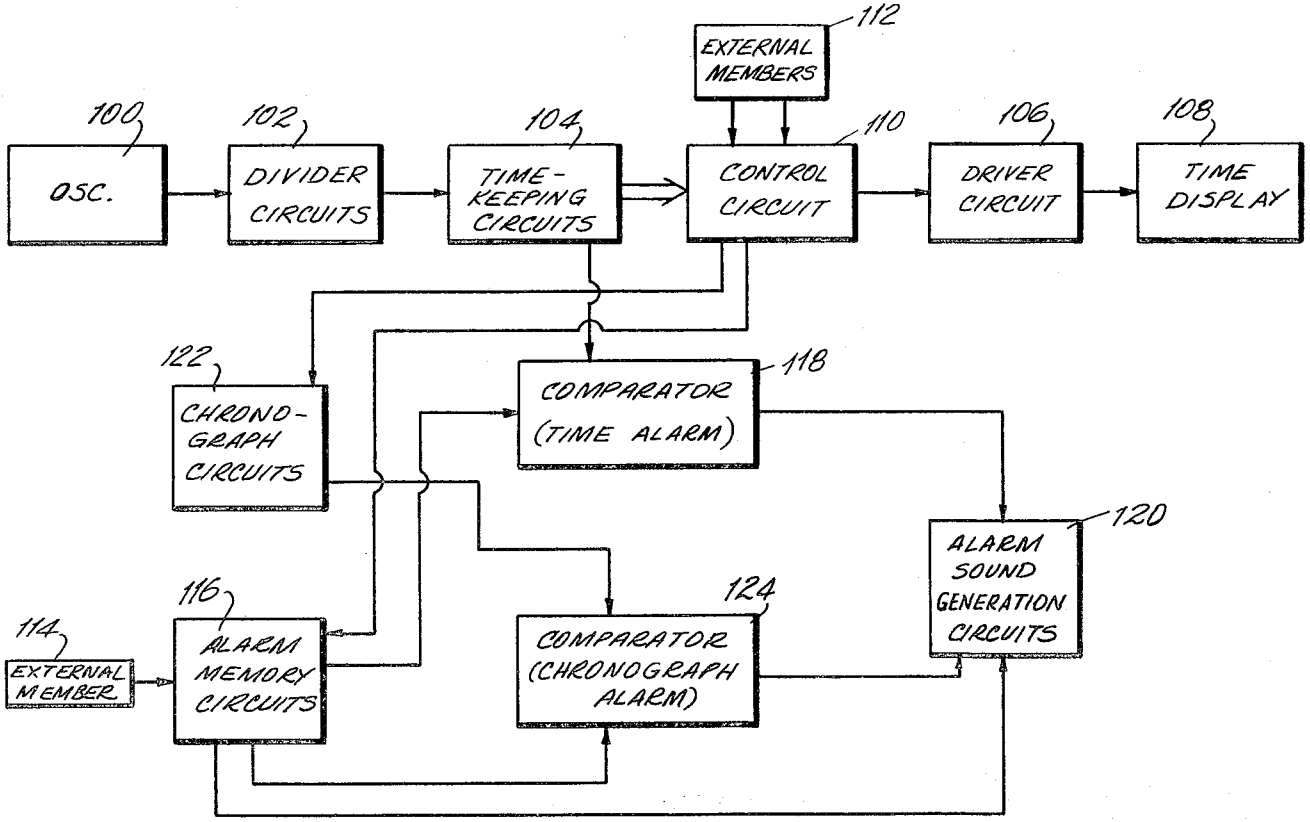
FIG. 12 is a functional block diagram of a watch with conventional and chronograph alarms.

FIG. 12 shows chronograph circuits 122 receiving timing signals from the timekeeping circuits 104 by way of the control circuit 110 and having the count in the chronograph circuits 122 compared with a value stored in the alarm memory circuits 116 by means of a comparator 124. Upon coincidence between the stored alarm data and the chronograph count, the comparator 124 outputs a signal to the alarm sound generator 120 which emits an audible sound. The sound produced by the chronograph function has a different rhythmic content from the alarm sound produced using the timekeeping function.

A tenth embodiment in accordance with this invention is provided with a circuit for generating alarm sound rhythms individually for the different kinds of alarm setting functions, for example, alarm set for the schedule display, normal alarm sets using the time display, or chronograph alarm settings.

Figure 7:
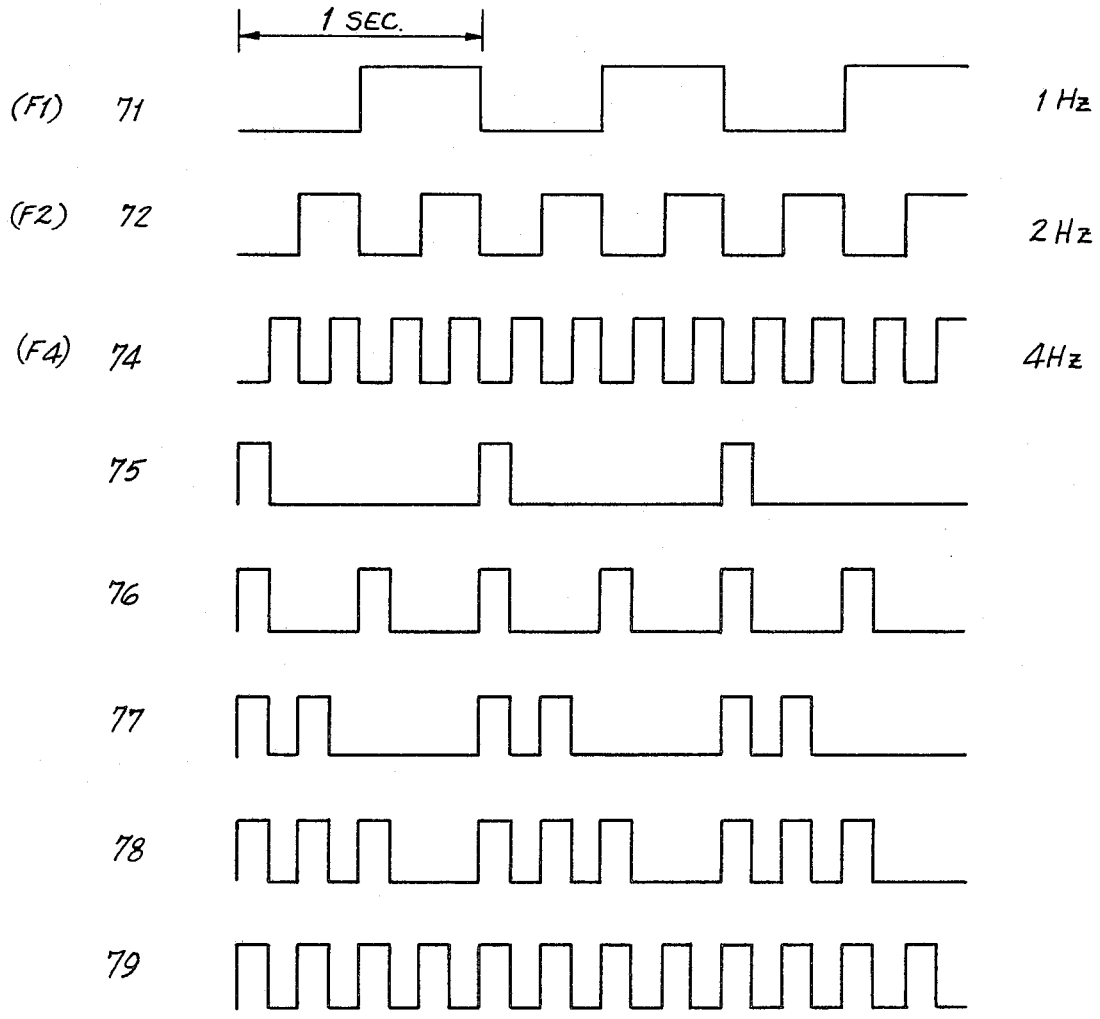
FIG. 7 shows signal wave forms related to the audible alarm sound circuits of watches of FIGS. 1 and 2.

FIG. 7 shows reference timing signals and signals for establishing alarm sound rhythms. Reference signals F1 (Hz) 71, F2 (2 Hz) 72, and F4 (4 Hz) 74 are generated. From these reference signals are produced a daytime schedule alarm sound rhythm signal 75, nighttime schedule alarm rhythm signal 76, first normal alarm sound rhythm signal 77, second normal alarm sound rhythm signal 78, and chronograph alarm sound signal 79. These rhythms are satisfactorily distinguishable one from the other even when they are emitted continuously.

Figure 8:
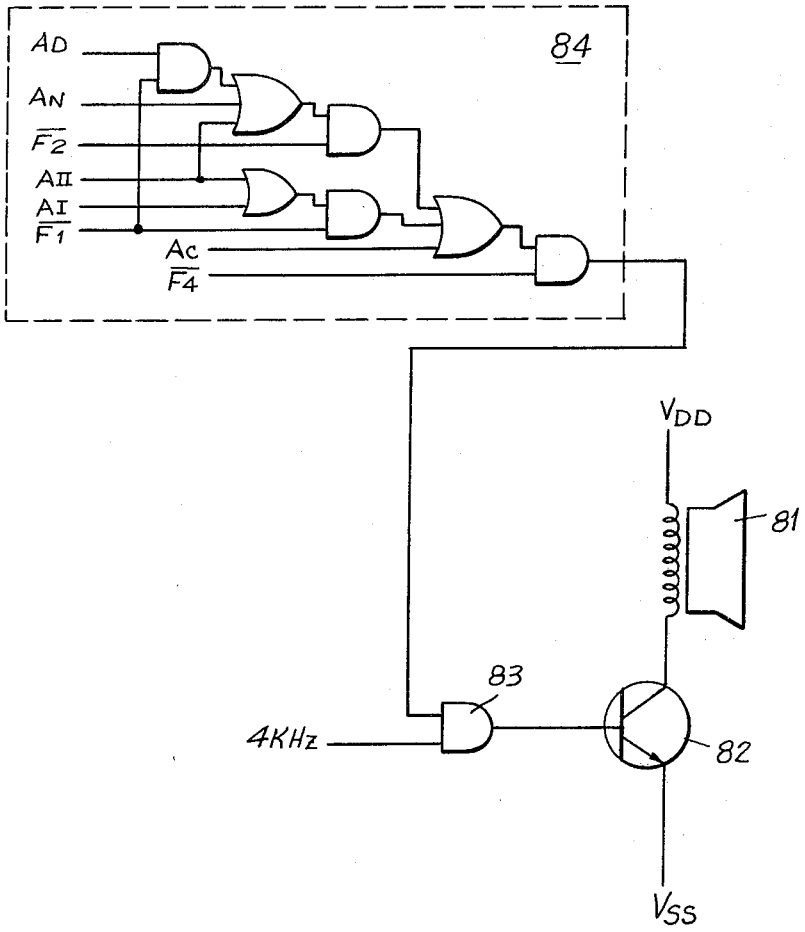
FIG. 8 shows an alarm sound generating circuit for use with the signals of FIG. 7.

An alarm sound generating circuit is shown in FIG. 8 wherein $A_D$, $A_N$, $A_I$, $A_{II}$ and $A_C$ indicate alarm generating signals for a daytime schedule, nighttime schedule, first normal, second normal and chronograph alarms respectively. These generating signals assume high levels when coincidence is detected in their respective coincidence circuits. A logic circuit 84, comprised of AND and OR gates is inputted the aforementioned alarm generating signals and selectively generates the rhythm signals 75, 76, 77, 78, 79. The logic circuit 84, enclosed in broken lines, performs in accordance with the formula:

$$F_4\{(A_{II}+A_N+A_D\cdot F_1)F_2+(A_{II}+A_I)F_I+A_C\}$$

A logical product between the rhythm signals 75–79 and a high frequency signal of approximately 4 KHz is obtained by an AND circuit 83. In response to the logical product, a buzzer 81 is driven through a NPN transistor 82 and thereby emits sounds. The entire alarm sounding circuit, except for the buzzer 81 and the transistor 82, can be integrated on a single substrate.

Figure 9:
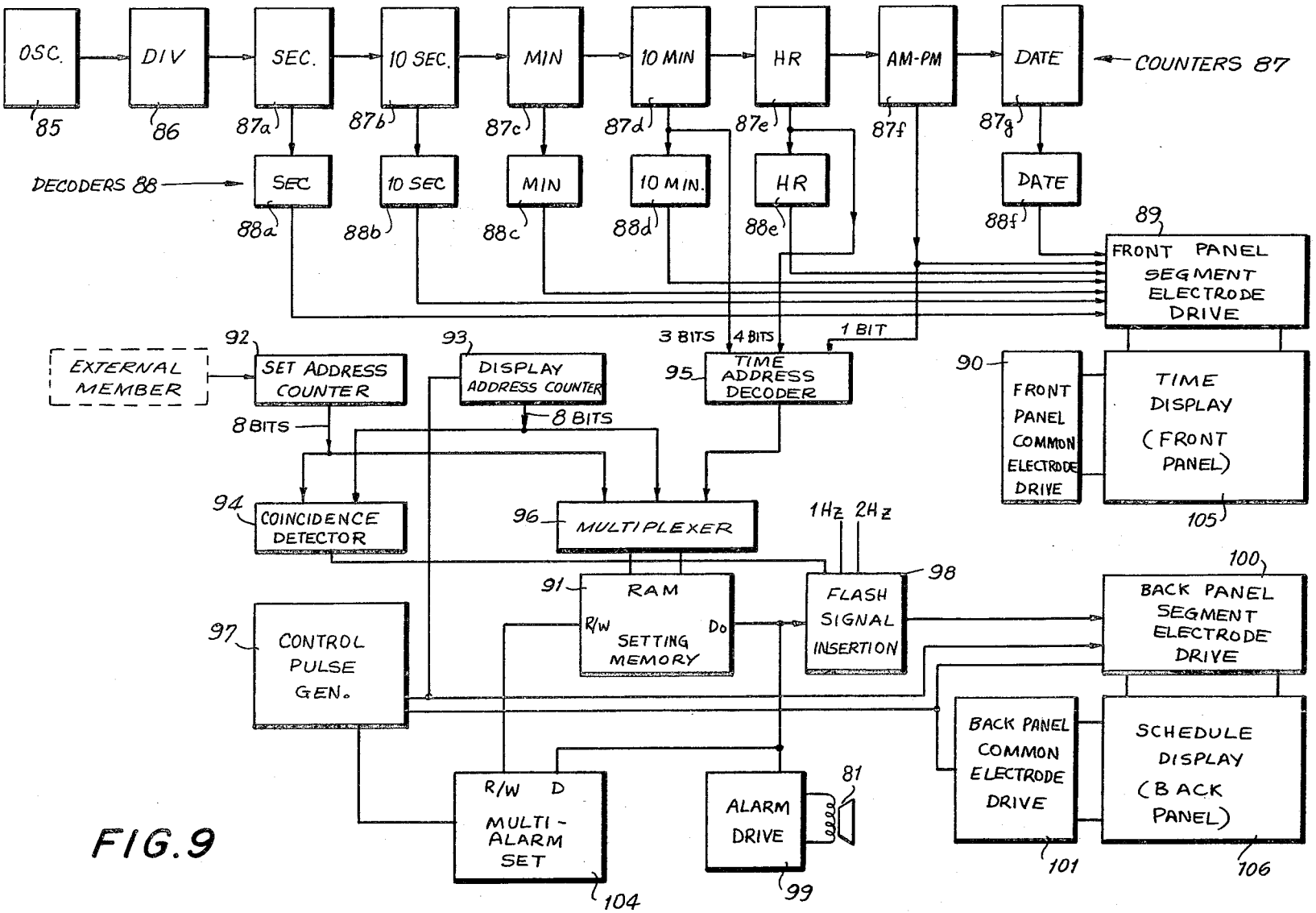
FIG. 9 is a functional block diagram of a multi-alarm electronic watch in accordance with this invention.

A multi-alarm setting circuit showing the concept and substance of the present invention is described in the following text. FIG. 9 is a functional block diagram showing an embodiment in accordance with this invention, which is comprised of a quartz crystal oscillator 85, a frequency dividing circuit 86, a second counter 87*a*, a 10-second counter 87*b*, a minute counter 87*c*, a ten-minute counter 87*d*, an hour counter 87*e*, an AM-PM counter 87*f* and a date counter 87*g*. This circuit also includes a second decoder 88*a*, a ten-second decoder 88*b*, a minute decoder 88*c*, ten-minute decoder 88*d*, an hour decoder 88*e* and a date decoder 88*f*. Further, this circuit includes a front panel segment electrode drive circuit 89, a front panel common electrode drive circuit 90, a random access memory (RAM) 91, a set address counter 92, a display address counter 93, a coincidence detecting circuit 94, a time address decoder 95, a multiplexer 96, a control pulse generating circuit 97, a flashing signal insertion circuit 98, an alarm drive circuit 99, and a buzzer 81. Also included are a back panel segment electrode drive 100, a back panel electrode 101, a multi-alarm set circuit 104, a time display panel 105, and a schedule display panel 106.

The counters 87*a–g* are arranged in series and receive carryover signals from the preceding counter and the second counter 87*a* received signals from the divider circuit 86. The decoders 88*a–f* associate with the second, ten-second, minute, ten-minute, hour, and date counters respectively, and feed their outputs to the front panel segment electrode drive circuit 89 such that the time display 105 operates in a conventional manner. As explained more fully hereinafter the output of the counters 87*d–f* are inputted to the time address decoder 95 and are used in association with the schedule display. The schedule display 106 is of the matrix type, for example, as shown in FIGS. 3 or 4, which is conventionally driven by signals from the back panel segment electrode drive 100 and the back panel common electrode drive 101. Additionally, a conventional watch is frequently equipped with month, year and date counters and decoders, all of which are not novel portions of this invention and are given no further detailed description here. Moreover, a chronograph circuit and conventional time alarm circuits are also lacking a full description here.

In a normal time display mode, a standard frequency signal, having a frequency of 32,768 Hz, is generated by the quartz crystal oscillator 85 and is divided down by the frequency dividing circuit 86 to provide signals of 1 Hz. The 1 Hz signals are outputted so that the respective counters 87*a* to 87*g* are actuated. The outputs of the counters are decoded by the associated decoders 88*a* to 88*f* to signals which are fed to the time display panel segment electrode drive circuit 89 to generate signals for driving the display segments.

When the multi-alarm settings can be made for each ten minute increment of an hour, as in the embodiment of FIG. 4, a setting memory 91 of 144 bits, that is, $6\times24=144$, is required. In accordance with this invention, a random access memory (RAM) 91 is used as the setting memory. Then, since storage of data for each ten minute interval is possible, one period of ten minutes is designated by 8 bits of data, namely, the outputs of the ten-minute counter 87*d*, hour counter 87*e* and the AM PM counter 87*f*. As a result, the set address counter 92 and the display address counter 93 also have outputs of eight bits. The outputs of the respective address counters 92, 93 and the address decoder 95 are switched at desired times by the multiplexer 96 and are fed into an address of the RAM 91. When the output data of the ten minute counter 87*d* changes, the multiplexer 96 feeds data from the address decoder 95 into the RAM 91. If, at this instant, the data in the corresponding address is at a level "1", the alarm drive circuit 99 is turned ON to feed the aforementioned rhythm signals to the buzzer 81 so that alarm sounds are emitted. On the other hand, if the data of the corresponding address of the RAM 91 is at a level "0", the alarm drive circuit 99 remains non-conductive so that the buzzer 81 does not sound any alarm. These operations of comparing the present time with the stored data is accomplished every ten minutes throughout all the modes of operation of the timepiece.

In the mode of operation for displaying the above-described schedule, the display address counter operates. In the mode for setting the schedule, the display address counter is operated with a fixed period and the set address counter 92 is operated by means of an external input using an external member. It is important to note that the schedule display is divided into halves of twelve hours for daytime and nighttime, each half extending from six o'clock to five o'clock. On the other hand, the hour counter 87*e* and the AM-PM counter 87*f* are operated with each half, that is, twelve hours, being from twelve to eleven o'clock whether it is AM or PM. As a result, when the outputs of the hour counter 87*e* are denoted as $h_1$ to $h_4$ and when the outputs of the AM-PM counter 87*f* are denoted as A/P, the six o'clock display elements, positioned at the most left-hand side of the schedule display of the back panel (FIGS. 3,4), is established for $h_1=0$. Then, $h_2=1$, $h_3=1$, $h_4=0$ and $A/P=0$. If, therefore, the data of $h_1$ to $h_4$ and A/P were used directly, the circuit construction of the display address counter 93 and the set address counter 92 would become remarkably complex. This would occur because the bits of those counters corresponding to the outputs $h_1$ to $h_4$ and A/P cannot start from 0. Therefore, when the bits identifying the addresses of the RAM are denoted as $H_1$ to $H_4$ and D/N corresponding to the $h_1$ to $h_4$ and A/P, the codes for $H_1=0$, $H_2=0$, $H_3=0$, and $H_4=0$, are used at six o'clock. For the daytime display from six o'clock to five o'clock, $D/N=0$. For the nighttime display, from 6 PM to 5 AM, $D/N=1$. Conversions between the time codes outputted from the counters 87*e* and 87*f* and the RAM address codes, are tabulated in Table 1. The address decoder 95 converts the time counter codes to the RAM codes.

The display address counter 93 designates the time 6:10, 7:10, and so on to 5:10 in a sequential manner in accordance with the signals from the control pulse generator 97. In response to an address signal fed from the multiplexer 96, the RAM 91 sequentially feeds data from the corresponding address to a terminal $D_0$. This data $D_0$ is fed through the flashing signal insertion circuit 98 to line memory in the panel segment drive circuit 100 used for display of the schedule. The data for one line is latched when introduced in a latched circuit in response to a clock signal coming from the control pulse generator 97. Thereby, the segment signals for the schedule display are inputted.

TABLE 1

| | TIME CODE | | | | | RAM ADDRESS CODE | | | | |
|---|---|---|---|---|---|---|---|---|---|---|
| | A/P | $h_1$ | $h_2$ | $h_3$ | $h_4$ | D/N | $H_1$ | $H_2$ | $H_3$ | $H_4$ |
| AM12 | 0 | 0 | 0 | 0 | 0 | 1 | 0 | 1 | 1 | 0 |
| AM 1 | 0 | 1 | 0 | 0 | 0 | 1 | 1 | 1 | 1 | 0 |
| AM 2 | 0 | 0 | 1 | 0 | 0 | 1 | 0 | 0 | 0 | 1 |
| AM 3 | 0 | 1 | 1 | 0 | 0 | 1 | 1 | 0 | 0 | 1 |
| AM 4 | 0 | 0 | 0 | 1 | 0 | 1 | 0 | 1 | 0 | 1 |
| AM 5 | 0 | 1 | 0 | 1 | 0 | 1 | 1 | 1 | 0 | 1 |
| AM 6 | 0 | 0 | 1 | 1 | 0 | 0 | 0 | 0 | 0 | 0 |
| AM 7 | 0 | 1 | 1 | 1 | 0 | 0 | 1 | 0 | 0 | 0 |

TABLE 1-continued

| | TIME CODE | | | | | RAM ADDRESS CODE | | | | |
|---|---|---|---|---|---|---|---|---|---|---|
| | A/P | $h_1$ | $h_2$ | $h_3$ | $h_4$ | D/N | $H_1$ | $H_2$ | $H_3$ | $H_4$ |
| AM 8 | 0 | 0 | 0 | 0 | 1 | 0 | 0 | 1 | 0 | 0 |
| AM 9 | 0 | 1 | 0 | 0 | 1 | 0 | 1 | 1 | 0 | 0 |
| AM10 | 0 | 0 | 1 | 0 | 1 | 0 | 0 | 0 | 1 | 0 |
| AM11 | 0 | 1 | 1 | 0 | 1 | 0 | 1 | 0 | 1 | 0 |
| PM12 | 1 | 0 | 0 | 0 | 0 | 0 | 0 | 1 | 1 | 0 |
| PM 1 | 1 | 1 | 0 | 0 | 0 | 0 | 1 | 1 | 1 | 0 |
| PM 2 | 1 | 0 | 1 | 0 | 0 | 0 | 0 | 0 | 0 | 1 |
| PM 3 | 1 | 1 | 1 | 0 | 0 | 0 | 1 | 0 | 0 | 1 |
| PM 4 | 1 | 0 | 0 | 1 | 0 | 0 | 0 | 1 | 0 | 1 |
| PM 5 | 1 | 1 | 0 | 1 | 0 | 0 | 1 | 1 | 0 | 1 |
| PM 6 | 1 | 0 | 1 | 1 | 0 | 1 | 0 | 0 | 0 | 0 |
| PM 7 | 1 | 1 | 1 | 1 | 0 | 1 | 1 | 0 | 0 | 0 |
| PM 8 | 1 | 0 | 0 | 0 | 1 | 1 | 0 | 1 | 0 | 0 |
| PM 9 | 1 | 1 | 0 | 0 | 1 | 1 | 1 | 1 | 0 | 0 |
| PM10 | 1 | 0 | 1 | 0 | 1 | 1 | 0 | 0 | 1 | 0 |
| PM11 | 1 | 1 | 1 | 0 | 1 | 1 | 1 | 0 | 1 | 0 |

While the data of the first line is effecting a display, the display address counter 93 designates the address of the following second line so that the data for the second line may be introduced into the line memory of the segment drive circuit 100. The subsequent displays are similarly brought about in a line sequential scanning system wherein the display of the first line is again effected following that of the sixth line.

The setting operations for the multiple alarms are accomplished such that when the external selecting means for timesetting is actuated, clock pulses are fed to the set address counter 92 so that the selected address data are fed through the multiplexer 96 to the RAM 91. Thus, by operating the external setting means, the multi-alarm set circuit 104 functions to bring the RAM 91 from a Read condition to a Write condition such that the selected data at a level "1" or "0" are then fed to the terminal $D_0$. In the multi-alarm setting mode, a display portion corresponding to the selected address flashes. On the other hand, the selected address flashes in a different flashing mode when the data at the level "1" is fed from the RAM 91, that is, when the alarm sounds are emitted at the time corresponding to the selected address.

A circuit for effecting the flashing mode of operation is explained by assuming, only by way of example, that the flashing when an address is selected is effected by a $\frac{7}{8}$ duty cycle signal of 2 Hz, and the flashing when an address is set is effected by a $\frac{1}{2}$ duty cycle signal of 1 Hz. In order to effect the flashing operation exclusively in a display segment where the set address is selected, the outputs of the set address counter 92 and the display address counter 93 are fed to the coincidence detecting circuit 94. Only when coincidence is detected, the flashing signals are inserted into the data from the RAM 91 by the flashing signal insertion circuit 98. When the data from the counters 92, 93, are coincident, the output of the coincidence detecting circuit 94 has the level "1". When the signal from the coincidence detecting circuit 94 is at the level "0", the flashing signal insertion circuit 98 allows the data signals from the RAM 91 to pass therethrough unaffected. However, when a signal from the circuit 94 is at the level "1", the insertion circuit 98 generates a signal of 2 Hz and when the data signal of the Ram 91 is at a level "0", and a signal of 1 Hz when the data signal from the RAM 91 is at the level "1".

Figure 10:
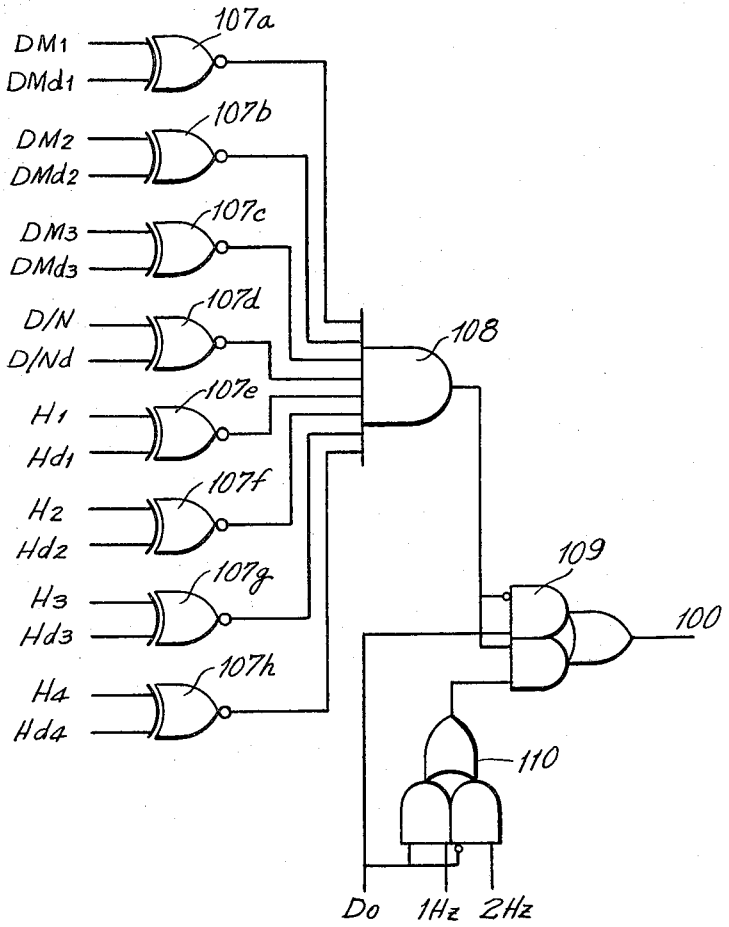
FIG. 10 is a coincidence detecting circuit and a flashing signal circuit for use in a watch in accordance with this invention.

FIG. 10 is an exemplary circuit of a coincidence detecting circuit 94 and the flashing signal insertion circuit 98. The circuits are comprised of exclusive NOR gates 107*a* to 107*h*, and AND gate 108 and AND-OR gates 109, 110. Here, $DM_1$ to $DM_3$ indicate bit data expressing how many ten minute intervals are counted by the set address counter 92. $H_1$ to $H_4$ indicate the bit data expressing the time counted by the set address counter 92. D/N indicates by bit data the daytime or nighttime. Signals having a lower case d attached thereto indicate data coming from the display address counter 93. When the respective corresponding bits are all equal, all the outputs of the exclusive NOR gates 107*a* to 107*h* assume a level "1" such that the ouput of the AND gate 108 also assumes the level "1". As a result, an AND gate of the AND-OR gate combination 109 which does not have an inverted input, is brought to a condition which allows the data to pass therethrough so that a signal from the AND-OR gate 110 is outputted 100. In the gate combination 110, the AND gate with the inverted input becomes effective to generate a signal of 2 Hz if the terminal $D_0$ is at the level "0". If, on the other hand, the terminal $D_0$ is at the level "1", a signal of 1 Hz is generated.

By means of the present invention, both alarm time setting which can be easily read out and a schedule which can easily be read are realized in a watch. Moreover, when the RAM circuit 91, or a similar circuit, is integrated on a substrate, the entire circuit can have its size reduced and can be satisfactorily applied in a wristwatch. Further, various alarm sounds can be distinguished in accordance with their rhythms even if an alarm setting independent of the schedule alarm settings is also included in the wristwatch. A watch with such a schedule display in accordance with this invention, whether a wristwatch or other portable watch, is superior to any similar watch of the prior art.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In a multi-alarm electronic watch having an oscillator generating a high frequency time standard signal, a divider circuit dividing down said high frequency standard signal, timekeeping means accumulating said divided signals in a plurality of time units, liquid crystal display means for display of said accumulated timekeeping signals, the improvement therein comprising:

an alarm circuit, said alarm circuit capable of being simultaneously and selectively set for a plurality of alarm times;

means for actuating said alarm circuit at each time corresponding to a set alarm time;

liquid crystal display means for simultaneous display of said plurality of set alarm times, signals from said alarm circuit causing said simultaneous display, said display means for simultaneous display providing a visible time schedule of said plurality of set times in the form of a grid matrix, said time schedule display means including a first group of electrodes, said first group of electrodes being divided into rows, and a second group of electrodes, said second group of electrodes being divided into columns, said rows and columns being transverse one to the other, the overlapped portions of said transverse electrodes forming picture elements in said grid matrix, said columns representing hours and said transverse rows representing portions of an hour in minutes, each selectable alarm time having a unique fixed location on said grid matrix, selected alarm times being indicated by an ON condition of said display at said respective fixed locations, non-selected alarm times being in an OFF condition at said respective fixed locations.

2. In a multi-alarm electronic watch of claim 1, the further improvement therein comprising:

a random access memory, said memory storing the multi-alarm settings for display on said means for simultaneous display of said plurality of alarm times; and a multi-alarm setting address counter, and a display address counter as the address counter of said random access memory.

3. A multi-alarm electronic watch as claimed in claim 1, wherein said liquid crystal display means are separated into a portion for said time display and a portion for said time schedule display.

4. A multi-alarm electronic watch as claimed in claim 1, wherein said liquid display means includes two overlapped liquid crystal layers, said time display being effected on one liquid crystal layer, said time schedule display being effected on the other liquid crystal layer, said overlapped displays being visible on an alternate basis.

5. The multi-alarm electronic watch as claimed in claim 3 or 4, wherein said time schedule display portion includes a first group of electrodes, said first group being divided into rows, and a second group of electrodes, said second group of electrodes being divided into columns, said rows and columns being transverse one to the other, the overlapped portions of said transverse electrodes forming picture elements in said grid matrix.

6. The multi-alarm electronic watch as claimed in claim 1, wherein electrodes are shaped such that said overlapped portions forming display elements form digits.

7. The multi-alarm electronic watch as claimed in claim 1, and further including electrodes for identifying each said row of said time schedule display by minutes, said identifying electrodes being in addition to said groups of electrodes for said time schedule display.

8. The multi-alarm electronic watch as claimed in claim 6, wherein said alarm circuit and said electrodes are adapted to effect a twelve hour alarm time schedule display and two time schedule displays are effected alternately to display an entire twenty-four hour period.

9. The multi-alarm electronic watch as claimed in claim 7, wherein said alarm circuit and said electrodes are adapted to effect a twelve hour alarm time schedule display and two time schedule displays are effected alternately to display an entire twenty-four hour period.

10. The multi-alarm electronic watch as claimed in claim 1, and further comprising circuit means for driving said liquid crystal display means by a generalized AC amplitude selective multiplexing method.

11. The multi-alarm electronic watch as claimed in claim 10, wherein said time display portion is driven by a V-2 V driving signal using a ½ duty cycle, said time schedule display portion is driven by a V-3 V driving signal using 1/n duty cycle, n equaling the number of said rows indicating minute portions.

12. The multi-alarm electronic watch as claimed in claim 10, wherein said time display portion is driven by a V-3 V driving signal using a ⅓ duty cycle, said time schedule display portion is driven by a V-3 V driving signal using 1/n duty cycle, n equaling the number of said rows indicating minute portions.

13. The multi-alarm electronic watch as claimed in claim 12, wherein driving of said time display portion is effected by V-3 V driving signals using a ⅓ duty cycle, and said overlapped transverse electrodes are held at the same potential for ¼ of the period of said AC multiplexed signal, whereby the effective voltage of said drive signals is reduced.

14. The multi-alarm electronic watch as claimed in claim 1, and further comprising an alarm time setting circuit and an alarm time schedule setting circuit, said alarm time setting circuit being separate from said alarm time schedule setting circuit.

15. The multi-alarm electronic watch as claimed in claim 1, and further comprising a chronograph function circuit and an alarm sound generating circuit, said alarm sound generating circuits generating sounds at a set time in synchronism with a measured time of said chronograph circuit.

16. The multi-alarm electronic watch as claimed in claim 1, and further comprising a circuit for generating alarm sounds at set times, and a circuit for modulating said alarm sounds to provide distinctive rhythms, said rhythms distinguishing different alarm functions of said watch.

17. The multi-alarm electronic watch as claimed in claim 16, wherein said different alarm setting functions include a conventional alarm, a chronograph alarm, and an alarm set on said time schedule display.

18. The multi-alarm electronic watch as claimed in claim 1, and further comprising an address decoder, said address decoder converting the outputs of a selective plurality of said timekeeping units into codes for said setting address counter and said display address counter.

19. The multi-alarm electronic watch as claimed in claim 18, wherein said timekeeping outputs include the units of ten minutes, hours and AM-PM.

20. The multi-alarm electronic watch as claimed in claim 1, and further comprising a coincidence detecting circuit, said coincidence detecting circuit comparing the outputs of said setting address counter and said display address counter, and a flashing circuit, said flashing circuit being connected between said random access memory and said liquid crystal display for said plurality of set alarm times, said flashing circuit inserting flashing signals to said display in response to said coincidence detecting circuit detecting coincidence of said outputs of said setting address counter and said display address counter.

21. A multi-alarm electronic watch as claimed in claim 19, and further comprising circuit means for inserting flashing signals of different wave form patterns, said wave form patterns differing in frequency or duty cycle, in response to a level "1" or level "0" in said random access memory at a selected address for the multi-alarm setting mode.

* * * * *